United States Patent [19]

McGeoch

[11] Patent Number: 5,003,226

[45] Date of Patent: Mar. 26, 1991

[54] PLASMA CATHODE

[75] Inventor: Malcolm W. McGeoch, Brookline, Mass.

[73] Assignee: Avco Research Laboratories, Everett, Mass.

[21] Appl. No.: 437,749

[22] Filed: Nov. 16, 1989

[51] Int. Cl.[5] ..... H01J 17/04

[52] U.S. Cl. ..... 315/111.81; 315/111.21; 315/111.31; 315/111.41; 313/231.31

[58] Field of Search ..... 315/111.21, 111.31, 315/111.41, 111.81; 313/231.31; 250/423 R, 427

[56] References Cited

U.S. PATENT DOCUMENTS

| | | | |
|---|---|---|---|
| 2,530,859 | 11/1950 | Charles | 250/84 |
| 3,005,931 | 10/1961 | Dandl | 315/111 |
| 3,155,858 | 11/1964 | Lary et al. | 313/63 |
| 3,201,635 | 8/1965 | Carter | 313/156 |
| 3,238,413 | 3/1966 | Thom et al. | 315/111 |
| 3,345,820 | 10/1967 | Masek | 60/202 |
| 3,371,489 | 3/1968 | Eckhardt | 60/202 |
| 3,416,021 | 12/1968 | Raezer | 313/161 |
| 3,613,370 | 10/1971 | Knauer et al. | 60/202 |
| 3,831,052 | 8/1974 | Knechtli | 313/231.31 X |
| 3,913,320 | 10/1975 | Reader et al. | 60/202 |
| 3,970,892 | 7/1976 | Wakalopulos | 315/111.31 |
| 4,156,159 | 5/1979 | Takagi | 313/155 |
| 4,297,615 | 10/1981 | Goebel et al. | 315/111.21 |
| 4,298,817 | 11/1981 | Carette et al. | 313/362.1 |
| 4,301,391 | 11/1981 | Seliger et al. | 315/111.31 |
| 4,322,661 | 3/1982 | Harvey | 315/344 |
| 4,339,691 | 7/1982 | Morimiya et al. | 315/111.21 |
| 4,458,180 | 7/1984 | Sohval et al. | 315/111.81 |
| 4,481,062 | 11/1984 | Kaufman et al. | 156/345 |
| 4,642,522 | 2/1987 | Harvey et al. | 315/111.81 X |
| 4,647,818 | 3/1987 | Ham | 315/111.21 |
| 4,684,848 | 8/1987 | Kaufman et al. | 315/111.81 |
| 4,707,637 | 11/1987 | Harvey | 315/111.81 |
| 4,777,370 | 10/1988 | Pigache et la. | 315/111.31 X |

OTHER PUBLICATIONS

Gutherie, A. and Wakerling, R., "The Characteristics of Electrical Discharges In Magnetic Fields", McGraw-Hill Books (1949), Chap. 10, pp. 334–344 (1949).

*Primary Examiner*—Eugene R. LaRoche
*Assistant Examiner*—Do Hyun Yoo
*Attorney, Agent, or Firm*—Perman & Green

[57] ABSTRACT

An apparatus is disclosed for producing an electron stream comprising an elongated first electrode and an elongated, surrounding electrode defining an exit aperture and spaced from the first electrode by an interelectrode distance. An gas source introduces ionizable gas between the electrodes. The interelectrode distance is typically less than the mean free path for molecular collisions in the gas, to thereby physically impede the flow of the gas in the interelectrode area. A magnetic field is applied between and parallel to the electrodes and an electric field is applied between the electrodes, both combining to discharge the gas. An extractor screen is juxtaposed to the exit aperture to attract an electron stream from the discharge. In preferred embodiments, the source of gas is pulsed and the screen is substantially transparent to electrons but only semi-transparent to gas molecules, thereby impeding their passage through the exit aperture.

12 Claims, 3 Drawing Sheets

PLASMA CATHODE

FIELD OF THE INVENTION

This invention relates to plasma cathodes, and more particularly to an improved crossed-field plasma cathode for producing an electron beam.

BACKGROUND OF THE INVENTION

Crossed-field plasma devices and other Penning discharge devices are known in the art. In such devices, an ionizable gas in a space between a pair of electrodes is subjected to electric and magnetic fields, at right angles. The magnetic field is generally parallel to the long dimension of the electrodes and the electric field is transverse. When a gas discharge is struck between the electrodes, ions and electrons in the resulting plasma are influenced by the fields, with electrons traveling a path whose direction is generally perpendicular to the plane of the crossed-fields. As a result, electrons generally proceed down the length of the electrodes by following a helical path in the interelectrode space. The combined fields produce an electron motion which allows the electrons to follow a longer effective path and create a resultant greater level of gas ionization.

Such structures have heretofore been used to create plasma guns, e.g. see U.S. Pat. Nos. 3,005,931 to Dandl, 3,201,635 to Carter and 3,238,413 to Thom et al. Additionally, such structures have been employed as parts of ion accelerators, e.g. see U.S. Pat. Nos. 3,155,858 to Lary et al and 3,345,820 to Dryden, and as part of a conduction control device, e.g. U.S. Pat. No. 4,322,661 to Harvey. Furthermore, such a structure has been employed as an electron generator, but with less than satisfactory results, i.e. see "The Characteristics of Electrical Discharges in Magnetic Fields", edited by Guthrie et al., first edition, McGraw-Hill Book Company, 1949, Chapter 10, "Discharge Cathodes" by Parkins, pp. 334–344. Parkins disclosed a crossed-field discharge device wherein electrons exited to their point of use along magnetic field lines. His structure employed a source of gas to feed a continuous discharge, thereby making it difficult to maintain the desired low pressure level within the beam acceleration structure, with the result that high voltage electron beam generation was not possible.

In order to generate high voltage electron beams (1 kilovolt to greater than 1 megavolt), the cathode must be electrically insulated from the anode by an appropriate vacuum space. Depending on the electron beam voltage and current density, a predetermined quality vacuum is required, typically better than $10^{-4}$ mm of Hg. However, to strike a crossed field discharge typically requires of the order of $10^{-2}$ mm Hg gas pressure. Thus a crossed field plasma cathode must generate the electron beam in an area of "high" pressure while at the same time conducting electrons, without hindrance, to an area of lower pressure (e.g. $10^{-4}$ mm Hg), and maintaining the highest level of electron discharge possible.

Accordingly, it is an object of this invention to provide an improved, crossed-field, electron beam generator capable of providing a high voltage electron beam.

It is still another object of this invention to provide an improved, crossed-field electron beam generator which is constructed to maintain an optimum internal discharge gas pressure while, at the same time providing a high voltage beam into a region of lower gas pressure.

It is a further object of this invention to provide a crossed-field electron beam source wherein arcing is avoided.

SUMMARY OF THE INVENTION

An apparatus is disclosed for producing an electron stream comprising an elongated first electrode and an elongated, surrounding electrode defining an exit aperture and spaced from the first electrode by an interelectrode distance. An ionizable gas source introduces gas between the electrodes. The interelectrode distance is typically less than the mean free path for molecular collisions in the gas, to thereby physically impede the flow of the gas in the interelectrode area. A magnetic field is applied between and parallel to the electrodes and an electric field is applied between the electrodes, both combining to discharge the gas. An extractor screen is juxtaposed to the exit aperture to attract an electron stream from the discharge. In preferred embodiments, the source of gas is pulsed and the extractor screen is substantially transparent to electrons but only semi-transparent to gas molecules, thereby impeding their passage through the exit aperture.

DETAILED DESCRIPTION OF THE INVENTION

Figure 1:
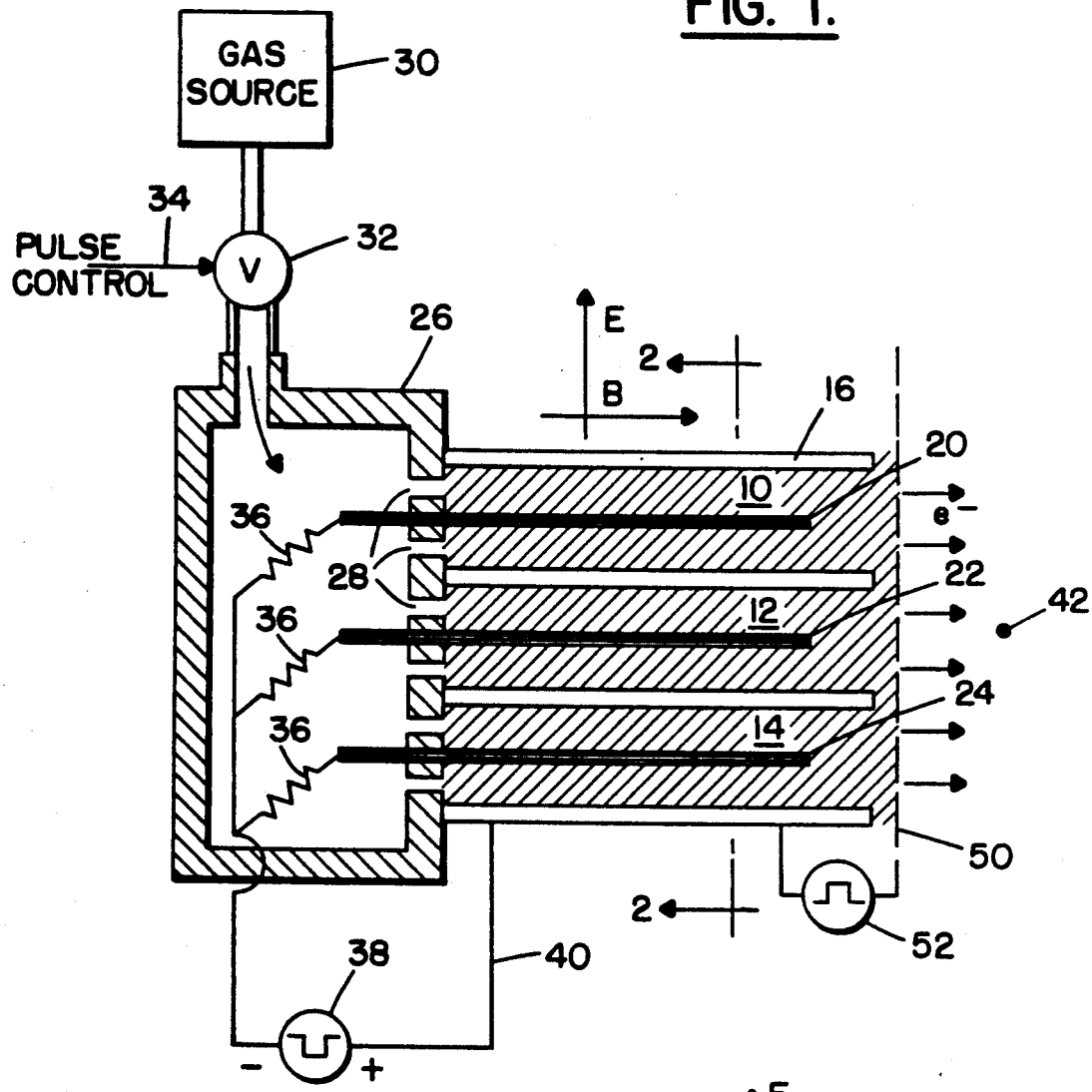
FIG. 1 is a sectional side view of a plasma cathode embodying the invention.
Figure 2:
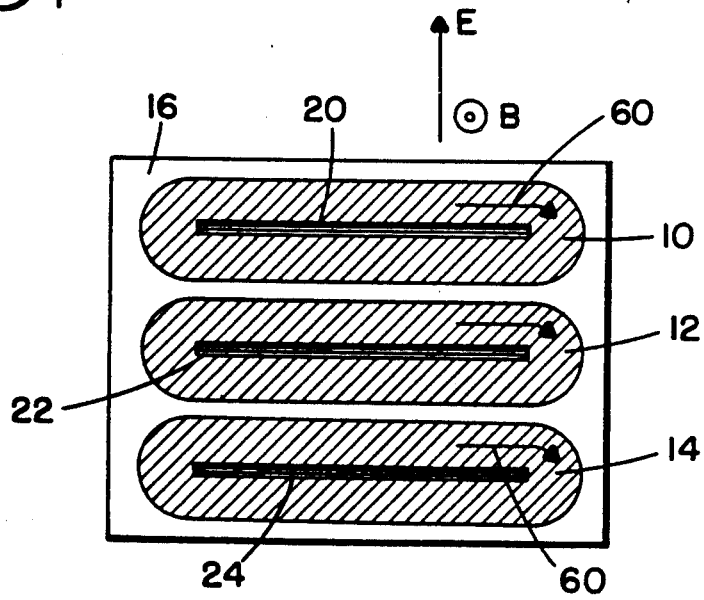
FIG. 2 is a section of FIG. 1 taken along line 2—2.
Figure 3:
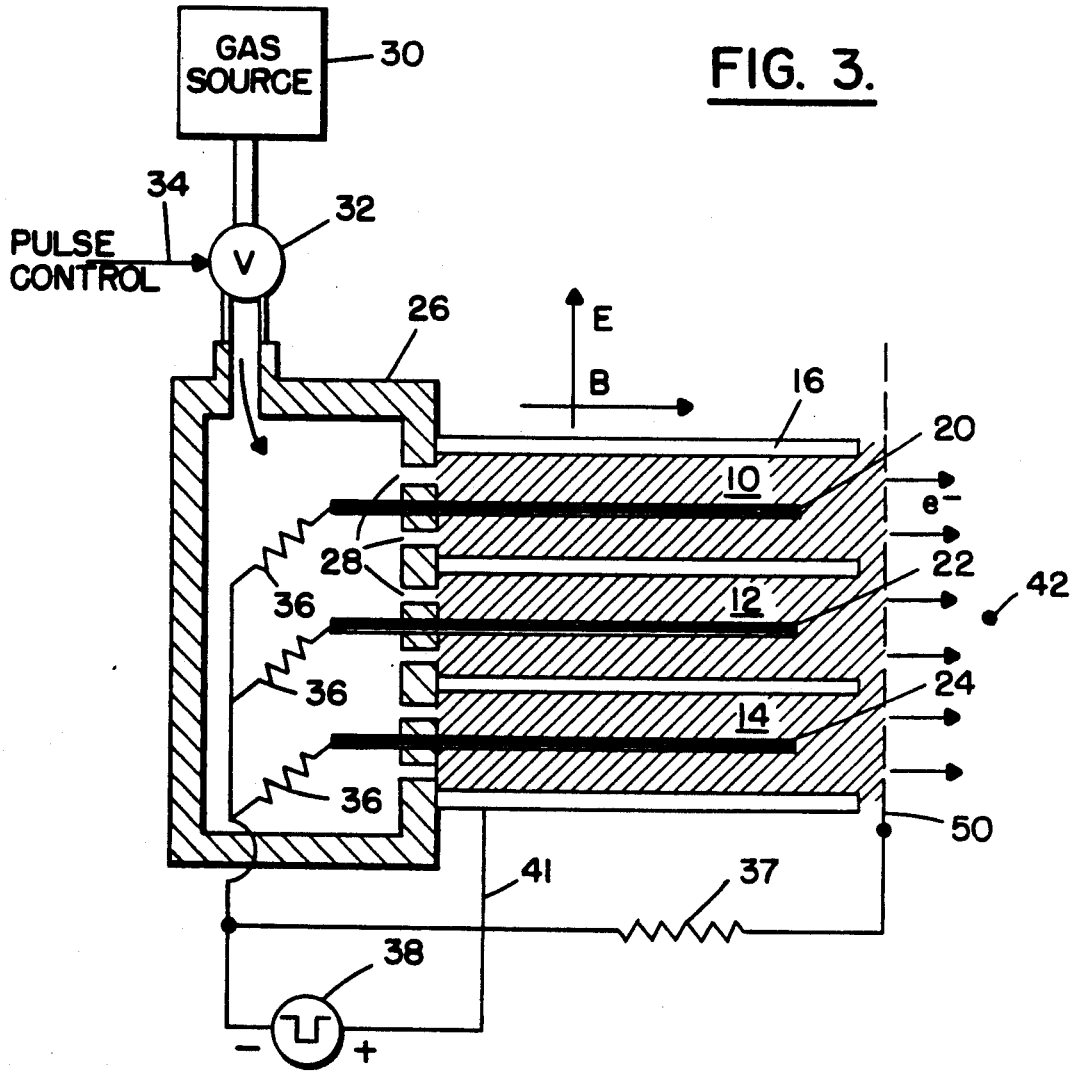
FIG. 3 is a sectional side view of a plasma cathode with a self-biased screen.

Referring now to FIGS. 1–3, a plasma cathode embodying the invention will be hereinafter described. Plasma chambers 10, 12, and 14 are contained within conductive housing 16. Housing 16 forms the anode structure of the electron generator while a plurality of plates 20, 22, and 24 act as the cathodes At the entrance end of plasma chambers 10, 12, and 14 is a gas introduction housing 26 which is provided with a plurality of communicating orifices 28, through which an ionizable gas may be introduced into each of the plasma chambers. A source of gas 30 is connected to gas introduction housing 26 via valve 32. While under certain conditions valve 32 may be continuously open during the operation of the plasma cathode, in the preferred embodiment, valve 32 is intermittently opened by a pulse control signal appearing on line 34. As a result, pulses of gas from gas source 30 are intermittently introduced into gas introduction housing 26. Gas introduction housing 26 additionally provides structural support for the plasma cathode structure.

Each of cathode plates 20,22, and 24 is connected via a resistance 36 to the negative terminal of a high voltage pulser 38. The positive terminal of pulser 38 is connected to anode structure 16 by conductor 40.

The entire plasma cathode structure is maintained in an area of high vacuum by a vacuum pump (not shown). In addition, external to the cathode structure is a further, high voltage accelerating structue (not shown) which applies a high voltage across accelerating gap 42.

Classically, the applied vacuum is approximately $10^{-4}$ mm Hg in gap area 42. Nevertheless, when pulses of gas are introduced from gas source 30, the pressure within each of plasma chambers 10, 12, and 14 rises to approximately $10^{-2}$ mm Hg. The resulting pressure differential has heretofore made high acceleration voltages difficult to sustain on a continuing basis because of rapid plasma expansion into acceleration gap 42.

It has been found that improved plasma stability results when a partially transmitting screen 50 covers the exit apertures from each of plasma chambers 10, 12, and 14 and is appropriately biased. Screen 50 is structured to be transparent to electrons, but to have a high impedance to gas flow. Thus, it is comprised of a conductive mesh wherein its apertures are fine holes which provide only 10–30% optical transmissivity. When screen 50 is biased to the same potential as anode 16, it not only provides an impedance to the gas flow, but also provides an additional anode structure at the plasma cathode's exit apertures and improves the stability of the plasma.

To contain the discharge plasma prior to electron extraction, a pulse bias source 52 is connected to screen 50 and maintains a potential thereon which repels electrons until extraction is desired; at which point its potential rises. In FIG. 3, an alternate bias technique is illustrated. Instead of employing a separate bias source, screen 50 is connected, via resistor 37, to the negative side of pulser 38. When a high voltage appears across acceleration gap 42, an automatic rise occurs in the bias of screen 50, thereby allowing electron flow.

External to the plasma cathode structure is a magnetic structure (not shown) which creates magnetic lines of force B which are parallel to the long dimensions of each of plasma chambers 10, 12, and 14. When a high voltage is applied between each of cathode plates 20, 22, and 24 and anode structure 16, an electric field E is created which is generally perpendicular to the long dimension of plasma chambers 10, 12, and 14. These fields, in combination create the known "crossed-field" field structure which controls electron and ion flow within each of the cathode chambers.

In operation, a gas pulse is introduced from gas source 30 into gas introduction housing 26 via valve 32. That gas is distributed to plasma chambers 10, 12, and 14 via apertures 28. An electric field E is then simultaneously applied across each of the cathode-anode gaps by pulse source 38 in order to initiate a discharge in each plasma chamber. As is known, to maintain such a discharge, a gas pressure typically on the order of $10^{-2}$ mm Hg or higher is required. Screen 50 helps to maintain that pressure and thus to maintain the stability of the discharges.

If extractor screen 50 is biased to a greater negative potential than cathode plates 20, 22, and 24, then no electron current can depart the plasma cathode structure. If it is biased by source 52 or by the electric field of the high voltage accelerating pulse to a potential more positive than anode 16, then an electron current leaves the device and enters the high vacuum region 42. Thus, a desired plasma current is established in each of discharge chambers 10, 12, and 14, and expands along the magnetic field lines to the plane of screen 50. When screen 50 is energized to draw electron current from each of the chambers the resulting electron beam current is approximately equal to the plasma current in chambers 10, 12, and 14.

The above-described structure presents a number of advantages. (a) The crossed-field discharge geometry in which the ExB electron drift is confined in a coaxial "racetrack" arrangement, leads to a high degree of discharge uniformity around the "loop" because electrons translate around the loop at velocities of $10^8$–$10^9$ cm/sec. If a closed loop is not employed, then "edge regions" of the discharge take up space and prevent the packing of minidischarges close together thereby decreasing the efficiency of electron generation. In FIG. 2 the "racetrack" of electrons is shown by arrows 60. (b) The crossed-field geometry enables operation at lower gas densities due to the electrons in the discharge track executing a skewed helical path and causing more ionizing collisions before being intercepted by an electrode structure. (c) The discharge is struck between parallel conducting surfaces whose planes and tangent planes contain the magnetic field vector. Gas is introduced only at the end of the structure furthest from the high vacuum, and flow of the gas down the structure is impeded by the relatively close spacing of the parallel surfaces. That spacing is typically less than the mean free path for gas collisions. The resulting gaseous "molecular flow" supports a steep pressure gradient between the plasma region and the high vacuum region. (d) Within the discharge, the magnetic field is oriented so as to guide secondary electrons produced in the discharge towards screen 50. This guide magnetic field thereby overcomes self-magnetic field limitations in high current electron beams and electrostatic affects in all beams. (e) Partially transmitting screen 50 serves to impede the flow of the ionized gas out of the discharge region into the area of high vacuum, while at the same time allowing electrons to exit from the discharge region. It further defines the electrical potential at the surface of the high voltage electron beam cathode. (f) Intermittent introduction of gas into the discharge chambers decreases the vacuum pumping needed to maintain the $10^{-4}$ mm Hg, or less, in the high vacuum space. It should be understood that intermittent gas supply is not essential to the invention, as it is possible, in high repetition rate electron beams, to have a continuous gas supply matched by a very high vacuum pump capacity.

Figure 4:
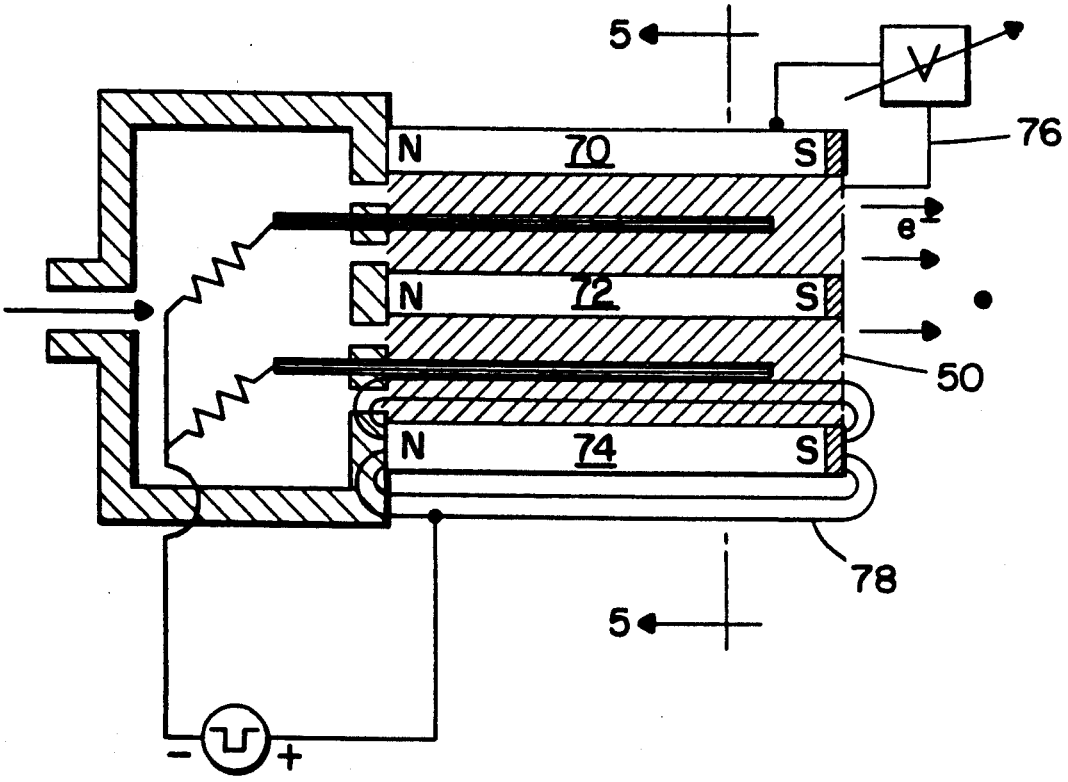
FIG. 4 is a modified plasma cathode constructed in accordance with the invention.
Figure 5:
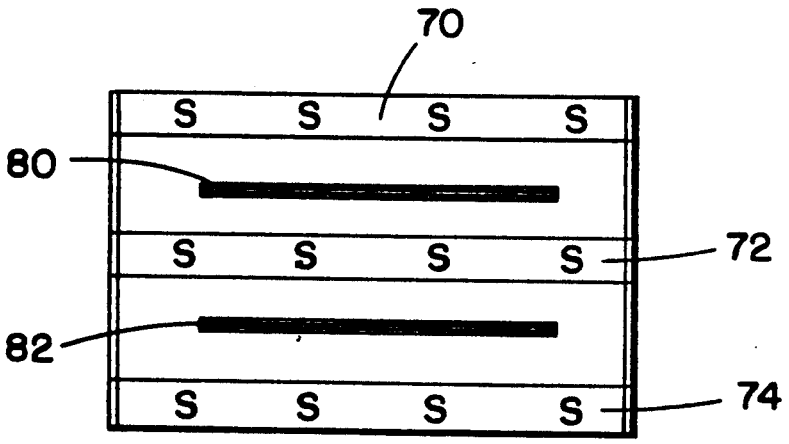
FIG. 5 is a sectional view of the plasma cathode of FIG. 4 taken along line 5—5.

Turning now to FIGS. 4 and 5, a modified plasma cathode is shown wherein the magnetic field B is provided by a plurality of magnets 70, 72, and 74 which are integral with the cathode structure. In addition, screen 50 is insulated from the anode structure and is connected by conductor 76 to bias voltage supply V. It may alternatively be biased by a resistive connection to magnets 70, 72, 74, or plates 80, 82.

Each of magnets 70, 72, and 74 imposes magnetic field lines 78 within the plasma chambers. Electrons, which are guided by these lines of force, rapidly leave their influence as they traverse into the region of lower pressure. The separate voltage supply to screen 50 enables it to perform both the plasma confining function and the electron accelerating function. In other respects, the operation of the plasma cathode of FIGS. 4 and 5 is identical to that of FIGS. 1 and 2.

Figure 6:
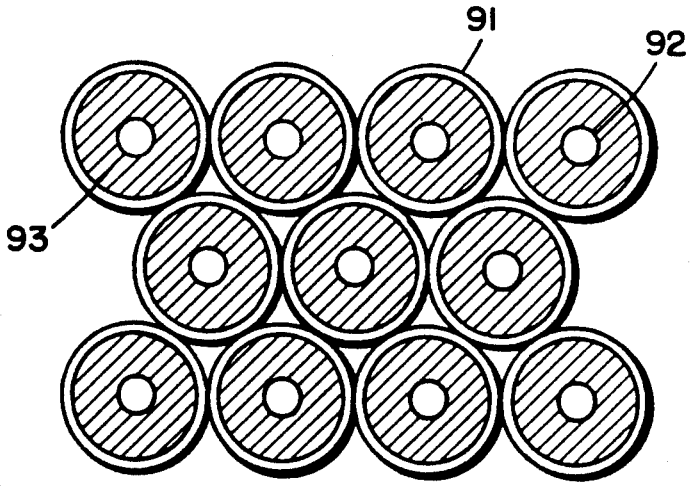
FIG. 6 is a sectional view showing an annular discharge region between coaxial cylindrical electrodes.

Although the specific designs above describe the basic principles of the invention, many variations in detail are possible. For example, the shape of the loop discharge cross sections can be varied. An annular discharge region between coaxial cylindrical electrodes (with the magnetic field parallel to their axes) is possible. Such a structure is shown in FIG. 6 with cathode electrodes 92 being cylindrical in shape, anodes electrodes 91 being annular thereabouts, thus creating annular dishcarge region 93. As indicated with FIGS. 4 and 5, screen 50 can be utilized to control electron flow while also functioning to confine the plasma discharge.

Typical order of magnitude parameters for the plasma cathode are as follows: instantaneous pressure in the discharge regions is in the range of $10^{-2}$ - $10^{-1}$ mm Hg and the pressure in the electron acceleration region is less than $10^{-4}$ mm Hg. The discharge anode and cathode are separated by 0.1 cm to 1.0 cm and the cathode plate dimensions are 1 cm to 5 cm parallel to B and 1 cm to 20 cm perpendicular to B. The voltage applied by source 38 is in the range of 0.3 kV to 3 kV and the applied magnetic field is in the range of 0.5 to 5 kG. The discharge current density on the cathode surface is 0.1 to 10 amps/sq. cm and the discharge pulse duration is 1 microsecond to 100 microseconds. An electron beam current density of 1 amp $cm^{-2}$ to 100 amps $cm^{-2}$ is extracted through screen 50.

It should be understood that the foregoing description is only illustrative of the invention. Various alternatives and modifications can be devised by those skilled in the art without departing from the invention. For instance, while plasma cathodes have been shown with two and three separate plasma chambers, any number of chambers may be utilized, depending upon the specific electron current flow required Accordingly, the present invention is intended to embrace all such alternatives, modifications and variances which fall within the scope of the appended claims.

I claim:

1. Apparatus for producing an electron stream in a vacuum space comprising:

elongated first electrode means;

elongated second electrode means having an exit aperture and surrounding said first electrode means and spaced therefrom by an interelectrode distance;

means for introducing an ionizable gas between said first and second electrode means;

means for applying a magnetic field between and parallel to said first and second electrode means;

means for applying an electric field between said first and second electrode means to discharge said ionizable gas; and screen means at said exit aperture for impeding flow of said ionizable gas through said aperture, said mean screen means enabling electron flow therethrough.

2. The apparatus as defined in claim 1 wherein said screen means comprises:

a screen positioned across said exit aperture; and means for biasing said screen.

3. The apparatus as defined in claim 2 wherein said means for biasing said screen is an electrical connection via a resistance to said first electrode means from said screen.

4. The apparatus as defined in claim 2 wherein said means for biasing said screen is a voltage supply connected between said second electrode means and said screen.

5. The apparatus as defined in claim 1, wherein said interelectrode distance is typically less than the mean free path for molecular collisions in said gas, to thereby physically impede the flow of said gas between said first and second electrode means.

6. The apparatus as defined in claim 2 wherein said screen means is substantially transparent to electrons, but only semi-transparent to gas molecules to thereby impede their passage through said aperture.

7. The apparatus as defined in claim 1 wherein said introducing means introduces said ionizable gas in pulses.

8. The apparatus as defined in claim 1 wherein said magnetic field applying means comprises permanent magnets incorporated as part of said elongated second electrode means.

9. The apparatus as defined in claim 1 wherein said magnetic field applying means is external to said elongated second electrode means.

10. The apparatus as defined in claim 1 wherein said apparatus comprises a plurality of said first electrode means, each said first electrode means surrounded by said second electrode means.

11. The apparatus as defined in claim 10 wherein each said first electrode means is planar in shape and said second electrode means surrounds each said first electrode means at a substantially constant interelectrode distance.

12. The apparatus as defined in claim 10 wherein each said first electrode means is cylindrical and each is surrounded by said second electrode means at a constant interelectrode distance.

* * * * *